US007053342B2

(12) United States Patent
Kim

(10) Patent No.: US 7,053,342 B2
(45) Date of Patent: May 30, 2006

(54) ELECTRIC COOKING APPARATUS AND METHOD OF CONTROLLING HEATERS THEREOF

(75) Inventor: Cheol Jin Kim, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/774,484

(22) Filed: Feb. 10, 2004

(65) Prior Publication Data

US 2005/0051534 A1 Mar. 10, 2005

(30) Foreign Application Priority Data

Sep. 9, 2003 (KR) ..... 10-2003-0063012

(51) Int. Cl.
*H05B 1/02* (2006.01)

(52) U.S. Cl. ..... 219/494; 219/492; 99/325

(58) Field of Classification Search ..... 219/492, 219/494, 497, 501, 506, 483–486, 412–414; 307/117; 374/120, 101, 102
See application file for complete search history.

(56) References Cited

U.S. PATENT DOCUMENTS 4,088,862 A * 5/1978 Austin ..... 219/719
4,333,519 A * 6/1982 Shafrir et al. ..... 165/259
4,947,875 A * 8/1990 Brooks et al. ..... 131/330
5,708,920 A * 1/1998 Ohnishi et al. ..... 399/69
6,140,619 A 10/2000 Couch
6,337,468 B1 * 1/2002 Worthington et al. ..... 219/497

FOREIGN PATENT DOCUMENTS

JP 04017816 A * 1/1992

* cited by examiner

*Primary Examiner*—Mark Paschall
(74) *Attorney, Agent, or Firm*—Staas & Halsey LLP

(57) ABSTRACT

An electric cooking apparatus and method of controlling heaters thereof, in which the heaters operate according to power-ON periods and power-OFF periods set in view of a temperature of the heaters, consumption of unnecessary power is reduced, and variations of heat supplied to a cooking cavity are decreased, thus improving quality of cooking and shortening overall cooking periods. The method includes detecting a temperature of a cooking cavity, and operating the heater according to preset power-ON and power-OFF periods allowing the heaters to maintain a temperature within a range around a certain temperature when the temperature of the cooking cavity reaches a set temperature.

15 Claims, 5 Drawing Sheets

ELECTRIC COOKING APPARATUS AND METHOD OF CONTROLLING HEATERS THEREOF

CROSS-REFERENCE TO RELATED APPLICATIONS

This application claims the benefit of Korean Patent Application No. 2003-63012, filed Sep. 9, 2003 in the Korean Intellectual Property Office, the disclosure of which is incorporated herein by reference.

BACKGROUND OF THE INVENTION

1. Field of the Invention

The present invention relates, in general, to an electric cooking apparatus and method of controlling heaters thereof and, more particularly, to an electric cooking apparatus and method of controlling heaters thereof, which are capable of uniformly maintaining a temperature of a cooking cavity by cutting off and supplying power to the heaters according to periods preset in view of a temperature of the heaters.

2. Description of the Related Art

Generally, an electric cooking apparatus is provided with electric heaters therein which cook food by heating the food with heat emitted from the electric heaters. The electric cooking apparatus typically includes a cooking cavity to accommodate food, electric heaters to supply heat to the cooking cavity, and a temperature sensor to detect a temperature of the cooking cavity.

Referring to FIGS. 1A and 1B, a conventional method of controlling heaters of the electric cooking apparatus is described below.

In FIG. 1B, an X-axis thereof represents periods, a Y-axis thereof indicates whether power is supplied or not to the heaters. A supply of power to the heaters is indicated by ON, while a cutoff of power to the heaters is indicated by OFF.

In FIG. 1A, an X-axis thereof represents periods, and a Y-axis thereof represents temperatures of the cooking cavity depending on supplies and cutoffs of power to the heaters that are plotted on the lower graph of FIG. 1.

When a cooking mode using the heaters is selected, it is determined whether the temperature of the cooking cavity input from the temperature sensor is higher or lower than a set temperature T1. If the temperature of the cooking cavity is lower than the set temperature T1, the heaters are turned on. Accordingly, the temperature of the cooking cavity increases by operation of the heaters. When the temperature of the cooking cavity increases higher than the set temperature T1 by a certain amount or more (for example, higher than the set temperature T1 by a temperature of +5° C.) (see position A), the power to the heaters is cut off.

When power to the heaters is cut off, the temperature of the cooking cavity slightly increases just after the cutoff of the power. Thereafter, the temperature of the cooking cavity decreases depending on an external temperature or an insulation state of the cooking cavity.

When the temperature of the cooking cavity decreases to less than the set temperature T1 by a certain amount or more (for example, lower than the set temperature T1 by a temperature of −5° C.) (see position B), power is supplied to the heaters again to increase the temperature of the cooking cavity.

When the power is supplied to the heater, the temperature of the cooking cavity increases again. When the temperature of the cooking cavity increases to a level higher than the set temperature T1 by a certain amount or more (see position C), the power to the heaters is cut off to maintain the temperature of the cooking cavity at a temperature near the set temperature T1. The above-described process is repeated during an overall cooking period.

In that case, a power-ON period is longer than a power-OFF period (for example, the power-ON period is twice the power-OFF period), and the power-ON period and the power-OFF period are set in minutes. Accordingly, when the temperature of the heaters is considerably decreased after the power to the heaters had been cut off and several minutes have elapsed, power is supplied to the heaters again.

As described above, the conventional electric cooking apparatus is problematic in that excessive power is consumed to resume a normal operation of the heaters because power is supplied to the heater again after the supply of power to the heater has been cut off and a considerable period has elapsed. Furthermore, the conventional electric cooking apparatus is problematic in that quality of cooking is reduced because the temperature of the cooking cavity is not accurately controlled but roughly controlled, and a cooking period increases because the heat is not uniformly applied to the food.

SUMMARY OF THE INVENTION

Accordingly, it is an aspect of the present invention to provide an electric cooking apparatus and method of controlling heaters thereof, in which the heaters operate according to power-ON periods and power-OFF periods set in view of a temperature of the heaters, consumption of unnecessary power is reduced, and variations of heat supplied to a cooking cavity are decreased, thus improving quality of cooking and shortening overall cooking periods.

The above and/or other aspects are achieved by providing a method of controlling heaters of an electric cooking apparatus, including detecting a temperature of a cooking cavity, and operating the heater according to preset power-ON and power-OFF periods to allow the heaters to be maintained at a temperature within a range around a certain temperature when the temperature of the cooking cavity reaches a set temperature.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the aspects, taken in conjunction with the accompanying drawings of which.

DETAILED DESCRIPTION OF THE PREFERRED EMBODIMENTS

Figure 1A:
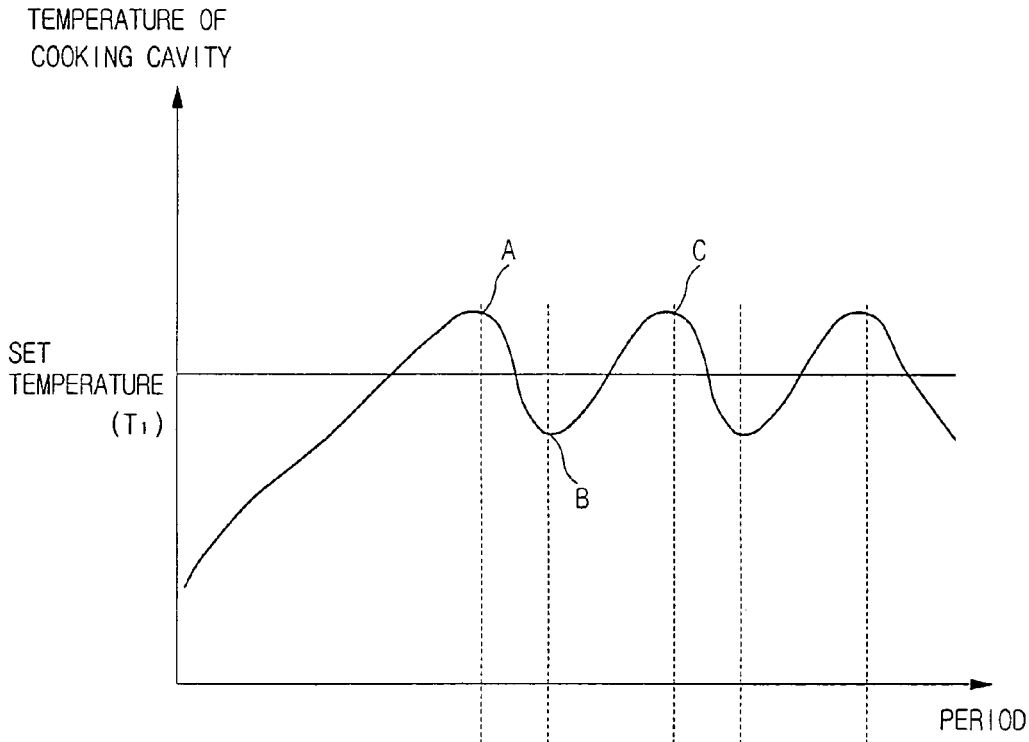
FIGS. 1A and 1B illustrate variations in a temperature of a cooking cavity, according to a conventional method of controlling heaters of an electric cooking apparatus.
Figure 1B:
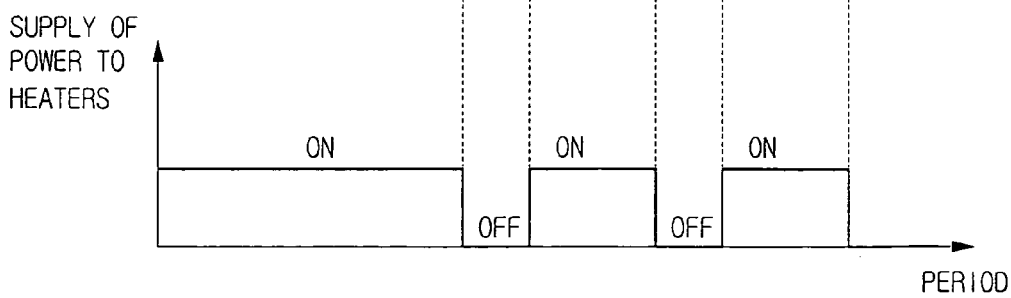

Reference will now be made in detail to the embodiments of the present invention, examples of which are illustrated in the accompanying drawings, wherein like reference numerals refer to like elements throughout. These embodiments are described below to explain the present invention by referring to the figures.

Figure 2:
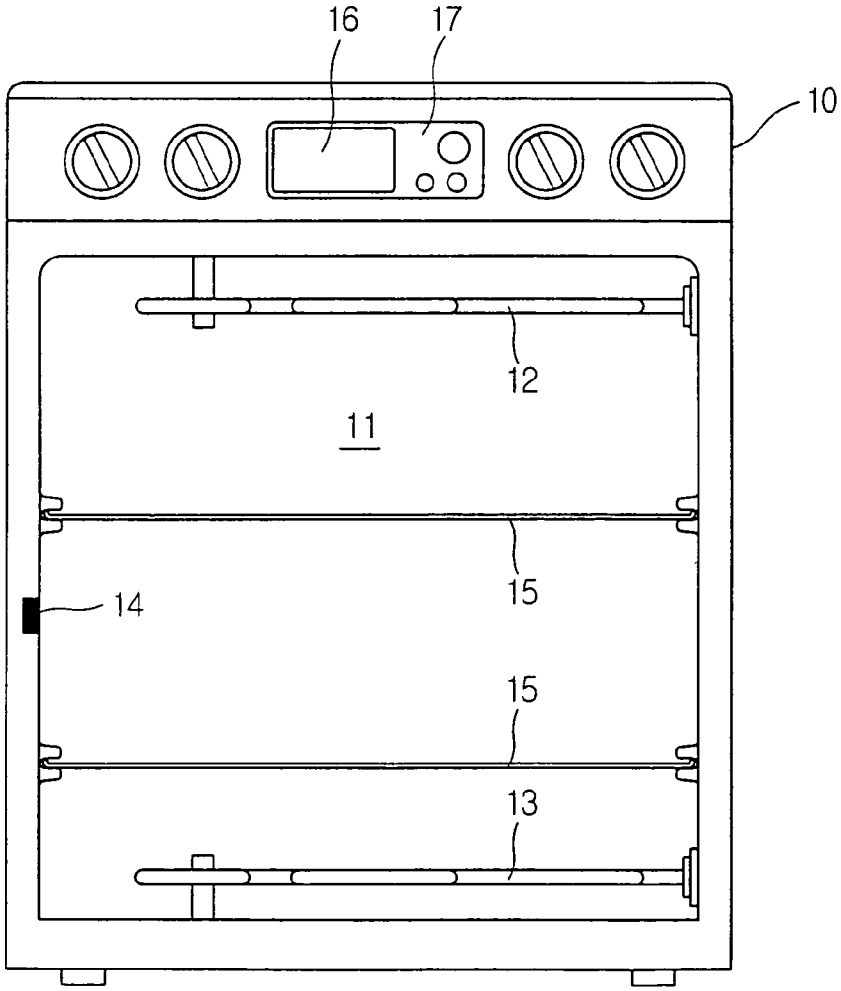
FIG. 2 is a front view of an electric oven with heaters, to which an embodiment of the present invention is applied.

Referring to FIG. 2, an electric oven to which the present invention is applied is described below.

The electric oven to which the present invention is applied includes a body 10, and a cooking cavity 11 provided in the body 10. An upper heater 12 and a lower heater 13 are installed in upper and lower portions of the cooking cavity 11 to be spaced apart from top and bottom of the cooking cavity 11 by certain intervals, respectively. A first end of each of the heaters 12 and 13 is fastened to a back wall of the cooking cavity 11, while a second end thereof is fastened using a fastening member fitted around the second end.

A temperature sensor 14 is embedded in a sidewall of the cooking cavity 11 to detect a temperature of the cooking cavity 11. Two food supports 15 are provided between the upper and lower heaters 12 and 13 to hold food.

A display unit 16 provided with a plurality of lamps to display operational status of the electric oven, and an input unit 17 used to input operation signals so as to operate the electric oven are disposed on an upper portion of a front of the body 10.

Referring to FIGS. 3A through 3C and 4, a method of controlling the heaters 12 and 13 of the electric oven is described below.

The heat controlling method of the present invention uses a phenomenon, in which a surface temperature of the heaters 12 and 13 does not decrease immediately but is maintained for a certain period (approximately two to four seconds) even though power is cut off.

In the case where power is supplied to the heaters 12 and 13 once again after a considerably long period has elapsed after power had been cut off, excessive power is consumed to increase the temperature of the heaters 12 and 13 to a certain temperature (for example, 1000° C.) suitable to cook food.

Accordingly, power required to increase the temperature of the heaters 12 and 13 may be reduced by supplying power within a period in which the heaters 12 and 13 are maintained at a surface temperature achieved when the power to the heaters 12 and 13 had been cut off, rather than supplying power once again after a considerably long period has elapsed since power had been cut off.

Figures 3A, 3B, 3C:
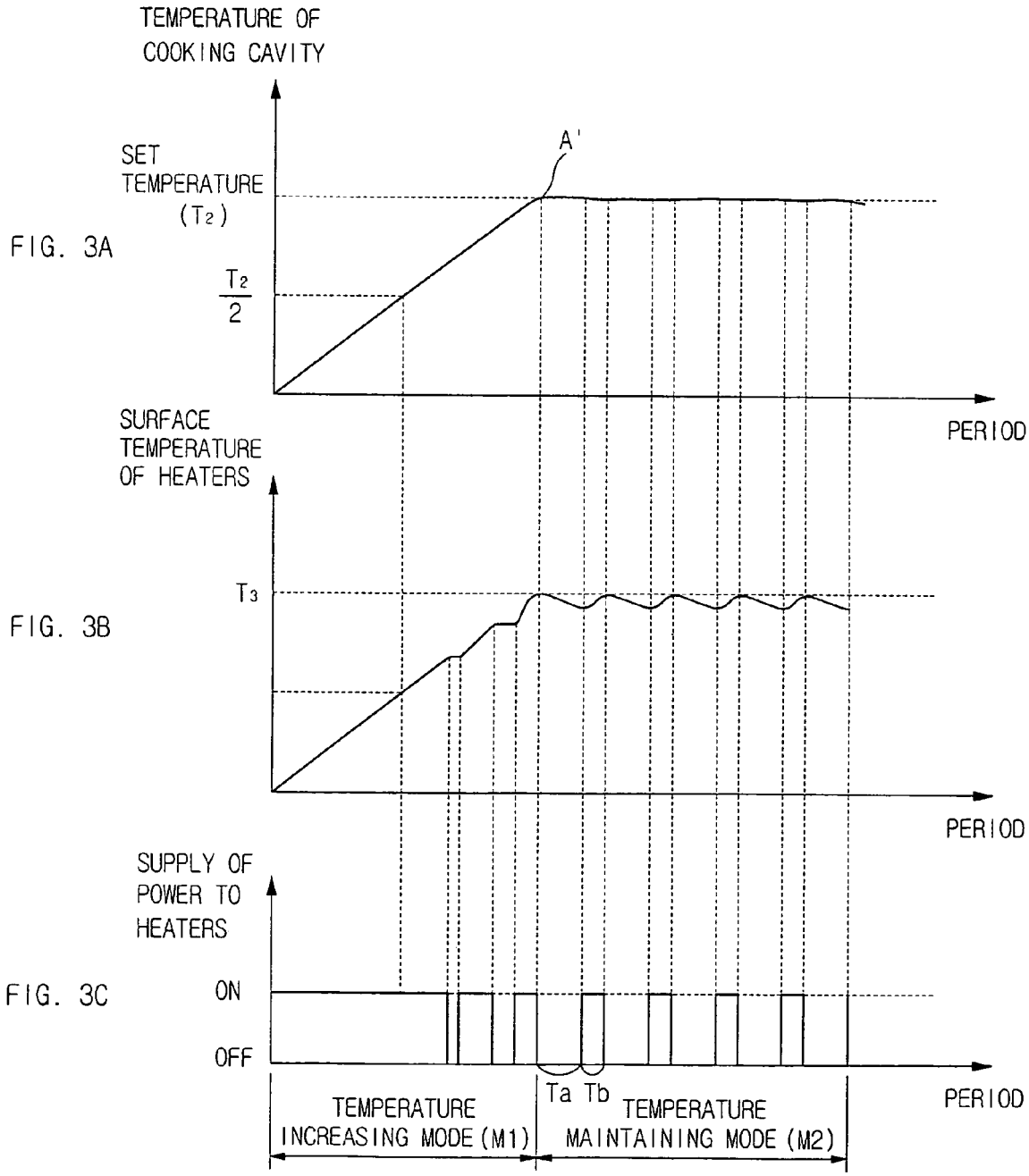
FIGS. 3A through 3C illustrate variations in a temperature of a cooking cavity and a surface temperature of the heaters, according to the present invention.
Figure 4:
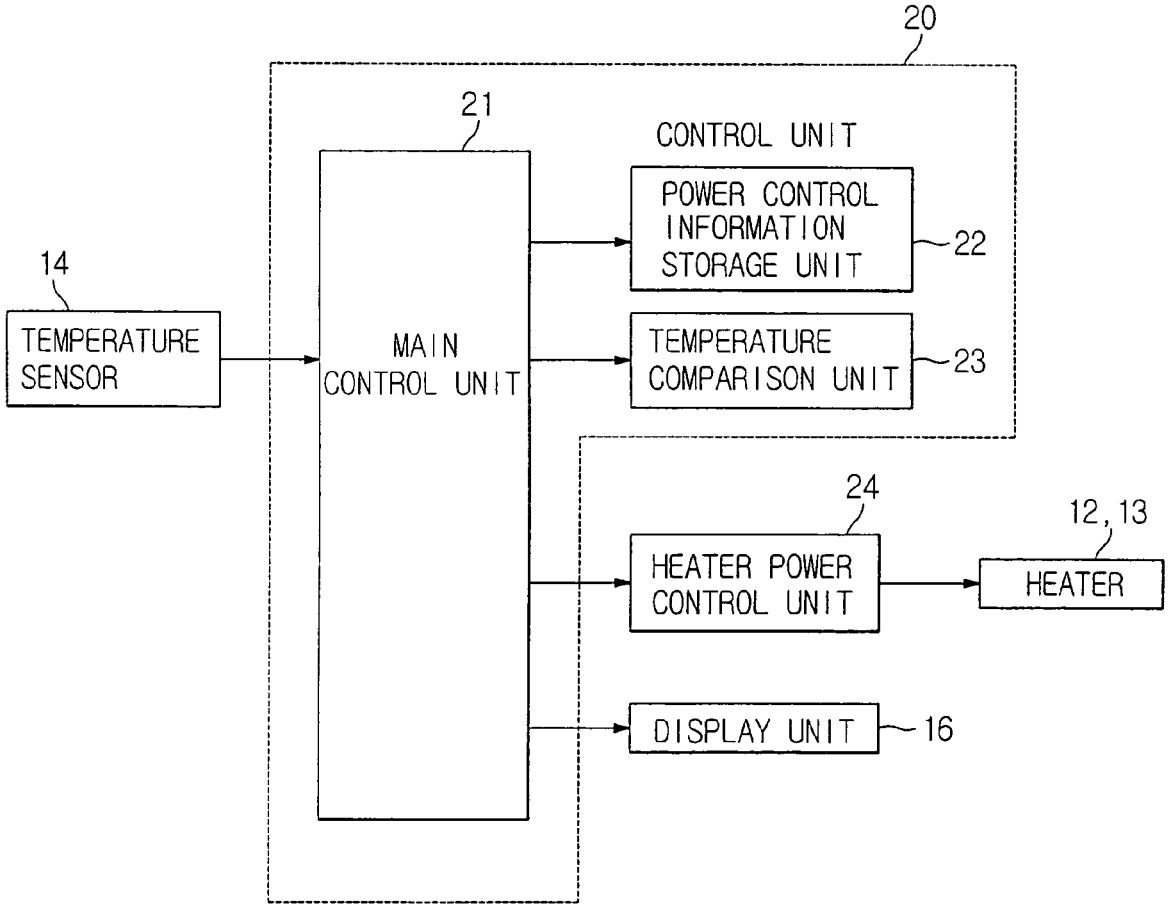
FIG. 4 is a block diagram of the electric oven of FIG. 2.

In FIG. 3C, an X-axis thereof represents periods, while a Y-axis thereof indicates whether power is supplied to heaters or power to the heaters is cut off. A supply of power to the heaters is indicated by ON, while a cutoff power to the heaters is indicated by OFF.

In FIG. 3B, an X-axis thereof represents periods, while a Y-axis thereof represents surface temperatures of the heaters.

In FIG. 3A, an X-axis thereof represents periods, while a Y-axis thereof represents temperature of the cooking cavity.

In FIG. 3C, an overall range may be divided into a temperature increasing mode M1 and a temperature maintaining mode M2.

Information about a temperature of the cooking cavity 11 detected by the temperature sensor 14 at an early stage is input to a temperature comparison unit 23 provided in a control unit 20. The temperature comparison unit 23 compares a set temperature T2 with the temperature of the cooking cavity 11 detected by the temperature sensor 14. If the set temperature T2 is equal to the detected temperature of the cooking cavity 11, a main control 21 performs the temperature maintaining mode M2. If the set temperature T2 is not equal to the detected temperature of the cooking cavity 11, the main control 21 performs a temperature correcting mode.

The temperature correcting mode is a mode that is performed when the set temperature T2 is different from the temperature of the cooking cavity. The temperature correcting mode may be divided into a temperature decreasing mode performed to decrease the temperature of the cooking cavity because the temperature of the cooking cavity is higher than the set temperature T2, and the temperature increasing mode M1 performed to increase the temperature of the cooking cavity because the temperature of the cooking cavity is lower than the set temperature T2.

In the temperature decreasing mode, to decrease the temperature of the cooking cavity, a heater power control unit 24 cuts off power from the heaters until the temperature of the cooking cavity reaches the set temperature T2. In the temperature increasing mode, the temperature of the cooking cavity is detected. If the temperature of the cooking cavity is lower than half of the set temperature T2, the heater power control unit 24 controls power to be continuously supplied to the heaters. In contrast, if the temperature of the cooking cavity is equal to or higher than half of the set temperature T2 and is lower than the set temperature T2, the heater power control unit 24 controls power to be alternately supplied and cut off according to information about power-ON periods and power-OFF periods stored in a power control information storage unit 22, with each of the power-ON periods being longer than each of the power-OFF periods.

With a lapse of time, the heater power control unit 24 decreases a ratio of the power-ON period and increases a ratio of the power-OFF period until the ratio of the power-ON period equals the ratio of the power-OFF period.

In that case, the power-OFF period of the heaters is preferably set in a range in which the heaters 12 and 13 are maintained at a surface temperature achieved when power to the heaters 12 and 13 is cut off.

When the temperature of the cooking chamber reaches the set temperature T2 while the temperature increasing mode M1 is performed in the above-descried manner, the temperature increasing mode M1 ends.

In this case, if the temperature of the cooking chamber is lower than half of the set temperature, the supply of power and the cutoff of power to the heaters 12 and 13 may be alternately performed rather than continuously.

When the temperature of the cooking chamber reaches the set temperature T2 (A' point), the control unit 21 performs the temperature maintaining mode M2. The temperature maintaining mode M2 is a mode in which the surface temperature of the heater, achieved when the temperature of the cooking cavity detected by the temperature sensor 14 reaches the set temperature M2, is maintained within a certain range.

If, in the temperature comparison unit 23, it is determined that the temperature of the cooking cavity is equal to the set temperature T2, the control unit 21 maintains the surface temperature of the heaters at this point.

In the temperature maintaining mode M2, a control may be performed to maintain the surface temperature of the heaters achieved when the surface temperature of the heaters reaches the set temperature T2, but the surface temperature of the heaters may also be controlled using data on temperatures of the cooking cavity corresponding to surface temperatures of the heaters after setting and storing the data. That is, if the temperature of the cooking cavity reaches the setting temperature, the main control unit 21 selects a corresponding temperature from the data on the temperatures of the cooking cavity corresponding to the surface temperatures of the heaters and controls the heaters maintaining them at the selected temperature. When the temperature of the heaters is controlled using the data, an operation of changing the temperature of the heaters to coincide with the data on the temperature of the cooking cavity corresponding to the surface temperature of the heaters is required. In the temperature maintaining mode M1, the method of detecting a surface temperature of the heaters achieved when the temperature of the cooking cavity reaches the set temperature T1 and maintaining the temperature of the heaters may be used. Alternatively, the method of selecting a certain temperature from stored data and controlling the temperature of the heaters may also be used.

To maintain the surface temperature T3 of the heaters, achieved when the temperature of the cooking chamber reaches the surface temperature T3 of the heaters, the heater power control unit 24 operates the power-ON periods Tb and the power-OFF periods Ta of the heaters, preset and stored in the power control information storage unit 22. In this case, each of the power-OFF periods Ta is preferably set within a range in which the surface temperature of the heaters does not considerably decrease, and the power-ON period Tb is preferably set to half of the power-OFF period Ta. The power-OFF period Ta is set to several seconds rather than several minutes as in a conventional scheme. The power-OFF period Ta may be set in view of an extent to which the surface temperature of the heaters decrease. As the power-OFF period Ta is increased, more power is consumed to increase the temperature of the heaters.

If the power-ON period Tb and the power-OFF period Ta stored in the power control information storage unit 22 are set to three and six seconds, respectively, an operation of supplying power to the heaters for three seconds and cutting off the power for six seconds is repeated.

In the power-ON period Tb, the surface temperature of the heaters rapidly increases, while, in the power-OFF period Ta, the surface temperature of the heaters slowly decreases. Even though the power-ON period is shorter than the power-OFF period, the surface temperature of the heaters is maintained without considerable change, thus maintaining the temperature of the cooking cavity at the set temperature.

As described above, the temperature of the cooking cavity may be increased in the temperature increasing mode and maintained in the temperature maintaining mode by controlling an interval between the power-ON period Tb and the power-OFF period Ta.

Power required to increase the temperature of the heaters again would be saved by supplying power to the heaters while maintaining the surface temperature of the heaters within a certain range after cutting off power from the heaters.

Furthermore, since overall power-OFF periods are smaller compared with overall power-ON periods, heat is uniformly supplied to the cooking cavity while consumption of power is considerably reduced.

Figure 5:
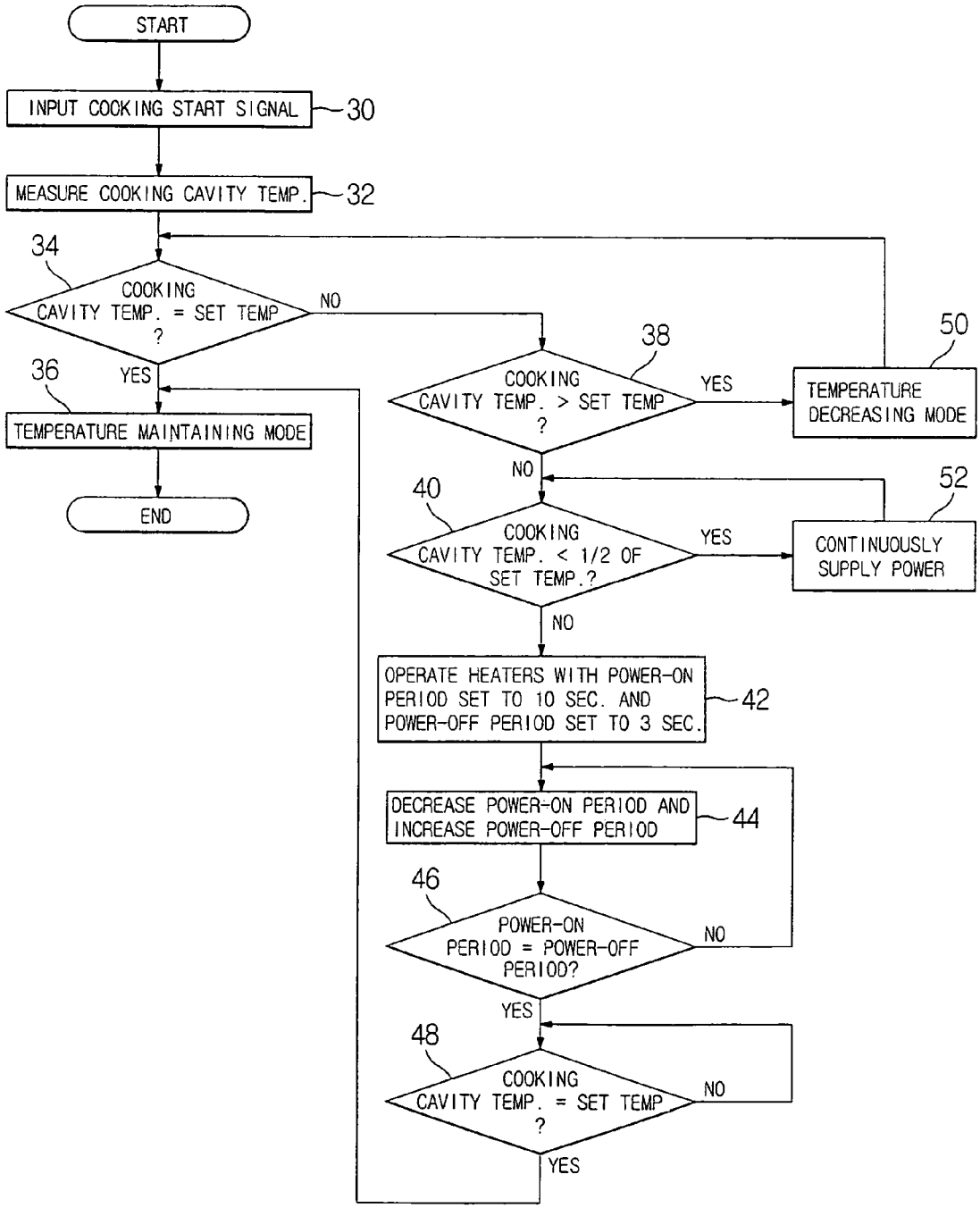
FIG. 5 is a flowchart showing a process of operating the electric oven of FIG. 2.

With reference to FIG. 5, a process of operating the electric oven is described below.

When power and a cooking start signal are applied in operation 30, the temperature sensor 14 detects a temperature of the cooking cavity in operation 32.

The detected temperature of the cooking cavity is input to the temperature comparison unit 23 through the main control unit 21. The temperature comparison unit 23 determines whether the detected temperature of the cooking chamber is equal to the set temperature T2 in operation 34.

If the detected temperature of the cooking cavity is equal to the set temperature T2, the temperature maintaining mode is performed maintaining the heaters at a surface temperature in operation 36. That is, the heater power control unit 24 operates the heaters according to power-ON periods and power-OFF periods preset and input to the power control information storage unit 22 maintaining the temperature of the cooking cavity.

If it is determined that the detected temperature of the cooking cavity is not equal to the set temperature T2 in operation 34, it is determined whether the temperature of the cooking cavity is lower than the set temperature T2 in operation 38. If the temperature of the cooking cavity is higher than the set temperature T2, the heater power control unit 24 cuts off power to the heaters by performing the temperature decreasing mode in operation 50.

If the temperature of the cooking cavity is lower than the set temperature T2, the temperature comparison unit 23 determines whether the temperature of the cooking cavity is lower than half of the set temperature T2 to perform the temperature increasing mode in operation 40. If the temperature of the cooking cavity is lower than half of the set temperature T2, the heater power control unit 24 continuously supplies power to the heaters. If the temperature of the cooking cavity is not lower than half of the set temperature T2, the heater power control unit 24 operates the heaters with the power-ON period set to ten seconds and the power-OFF period set to three seconds in operation 42. With a lapse of time, the power-ON period gradually decreases and the power-OFF period gradually increases in operation 44. In this case, an extent of the change may be appropriately set.

Thereafter, the main control unit 21 determines whether the power-ON period is equal to the power-OFF period in operation 46. If the power-ON period is not equal to the power-OFF period, the process returns to operation 44, if the power-ON period is equal to the power-OFF period, it is determined whether the temperature of the cooking cavity reaches the set temperature T2 in operation 48. If the temperature of the cooking cavity does not reach the set temperature T2, the process repeats operation 48, if the temperature of the cooking cavity reaches the set temperature T2, the process performs the temperature maintaining mode in operation 36. After performing operation 36, the process ends.

As is apparent from the above description, the present invention provides an electric cooking apparatus and method of controlling heaters thereof, in which a temperature of the heaters is utilized, thus improving a thermal efficiency with respect to power, and reducing variations of heat supplied to a cooking cavity, thus improving quality of cooking and shortening overall cooking periods.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of controlling heaters of an electric cooking apparatus, the method comprising:

detecting a temperature of a cooking cavity; and operating the heater according to preset power-ON and power-OFF periods to allow the heaters to be maintained at a temperature within a range around a certain temperature when the temperature of the cooking cavity reaches a set temperature, wherein each of the preset power-OFF periods is set to a period ranging from a first point, when power to the heaters is cut off, to a second point, when surface temperatures of each of the heaters decrease by a certain amount or less.

2. The method as set forth in claim 1, wherein each of the preset power-ON periods is set shorter than each of the preset power-OFF periods when the temperature of the cooking cavity reaches the set temperature.

3. The method as set forth in claim 1, wherein each of the power-OFF periods is set to be 1.5 to 3 times each of the power-ON periods.

4. A method of controlling heaters of an electric cooking apparatus, comprising:

detecting a temperature of a cooking cavity; and performing a temperature increasing mode in which a supply of power and a cutoff of power to the heaters are alternately performed while increasing a ratio of a power-OFF period to a power-ON period if the detected temperature of the cooking cavity is not equal to a set temperature, and performing a temperature maintaining mode in which the heaters are operated according to preset power-ON and power-OFF periods to be maintained at a temperature within a certain range around a certain temperature if the detected temperature of the cooking cavity reaches the set temperature, wherein the increasing the ratio of a power-OFF period to a power-ON period is continuous during the temperature increasing mode.

5. The method as set forth in claim 4, wherein each of the preset power-OFF periods is set to a period ranging from a first point, when power to the heaters is cut off, to a second point, when a surface temperature of heaters decreases by a certain amount or less.

6. The method as set forth in claim 4, wherein each of the preset power-ON periods is set shorter than each of the preset power-OFF periods when the temperature of the cooking cavity reaches the set temperature.

7. The method as set forth in claim 6, wherein each of the power-OFF periods is set to be 1.5 to 3 times each of the power-ON periods.

8. An electric cooking apparatus, comprising:

a detector detecting a temperature of a cooking cavity; and a control unit controlling heaters supplying heat to the cooking cavity to be operated according to preset power-ON periods and power-OFF periods so as to allow the heaters to be maintained at a temperature within a range around a certain temperature when the temperature of the cooking cavity reaches a set temperature.

9. The apparatus according to claim 8, wherein each of the preset power-OFF periods is set to a period ranging from a first point, when power to the heaters is cut off, to a second point, when a surface temperature of heaters decreases by a certain amount or less.

10. The apparatus according to claim 8, wherein each of the preset power-ON periods is set shorter than each of the preset power-OFF periods when the temperature of the cooking cavity reaches the set temperature.

11. The apparatus according to claim 8, wherein each of the power-OFF periods is set to be 1.5 to 3 times each of the power-ON periods.

12. A method of controlling heaters of an electric cooking apparatus, comprising:

inputting a cooking start signal;

measuring a temperature of a cooking cavity; and comparing a set temperature T2 with the temperature of the cooking cavity, wherein if the set temperature T2 is equal to a detected temperature of the cooking cavity, performing a temperature maintaining mode, and wherein if the set temperature T2 is not equal to the detected temperature of the cooking cavity, performing a temperature correcting mode, wherein in the temperature maintaining mode a surface temperature of the heaters is maintained within a certain range.

13. A method of controlling heaters of an electric cooking apparatus, comprising:

inputting a cooking start signal;

measuring a temperature of a cooking cavity; and comparing a set temperature T2 with the temperature of the cooking cavity, wherein if the set temperature T2 is equal to a detected temperature of the cooking cavity, performing a temperature maintaining mode, and wherein if the set temperature T2 is not equal to the detected temperature of the cooking cavity, performing a temperature correcting mode, wherein the temperature correcting mode is divided into a temperature decreasing mode and a temperature increasing mode.

14. The method according to claim 13, wherein in the temperature decreasing mode, to decrease the temperature of the cooking cavity, a heater unit cuts off power from the heaters until the temperature of the cooking cavity reaches the set temperature T2.

15. The method according to claim 13, wherein in the temperature increasing mode, if the temperature of the cooking cavity is lower than half of the set temperature T2, a heater unit controls power to be continuously supplied to the heaters, and wherein if the temperature of the cooking cavity is equal to or higher than half of the set temperature T2 and lower than the set temperature T2, the heater unit controls power to be alternately supplied and cut off to the heaters according to information about power-ON periods and power-OFF periods stored in a power control information storage unit, with each of the power-ON periods being longer than each of the power-OFF periods.

* * * * *